US005577710A

United States Patent [19]

Kirby

[11] Patent Number: 5,577,710

[45] Date of Patent: Nov. 26, 1996

[54] FENCE EXTENSION ASSEMBLY

[76] Inventor: George T. Kirby, 7695 Heather Cir., Buena Park, Calif. 90620

[21] Appl. No.: 488,483

[22] Filed: Jun. 8, 1995

[51] Int. Cl.[6] ..... E04H 17/00

[52] U.S. Cl. ..... 256/24; 256/11; 256/26; 411/384

[58] Field of Search ..... 256/11, 24, 26, 256/65; 411/383, 384

[56] References Cited

U.S. PATENT DOCUMENTS

| | | | |
|---|---|---|---|
| 731,890 | 6/1903 | Green | 256/11 |
| 3,096,079 | 7/1953 | Winn | 256/24 |
| 3,537,687 | 11/1970 | Adelman | 256/24 X |
| 4,070,006 | 1/1978 | Storie | 256/24 X |
| 4,124,198 | 11/1978 | Wong | 256/24 |
| 4,174,096 | 11/1979 | Campbell | 256/24 |
| 4,193,583 | 3/1980 | Witt | 256/11 |
| 4,685,656 | 8/1987 | Lee et al. | 256/24 X |
| 4,925,364 | 5/1990 | Das | 411/383 X |
| 5,100,108 | 3/1992 | Schultz | 256/24 |
| 5,143,354 | 9/1992 | Nolan | 256/11 X |
| 5,186,438 | 2/1993 | Cross et al. | 256/24 X |
| 5,395,093 | 3/1995 | Chrisman | 256/65 X |

FOREIGN PATENT DOCUMENTS

| | | | |
|---|---|---|---|
| 1501586 | 10/1967 | France | 256/24 |
| 430155 | 8/1967 | Switzerland | 256/65 |
| 2247901 | 3/1992 | United Kingdom | 256/24 |

*Primary Examiner*—Blair Johnson
*Assistant Examiner*—Andrea Chop

[57] ABSTRACT

An assembly for extending a vertical height of a fence. The inventive device includes a plurality of mourning posts securable to opposed sides of an existing fence. A plurality of panels extend between the posts and rest upon a top surface of the fence so as to extend an effective vertical height of the fence.

8 Claims, 4 Drawing Sheets

FENCE EXTENSION ASSEMBLY

BACKGROUND OF THE INVENTION

1. Field of the Invention

The present invention relates to fence structures and more particularly pertains to a fence extension assembly for extending a vertical height of a fence.

2. Description of the Prior Art

The use of fence structures is known in the prior art. More specifically, fence structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art fence structures include U.S. Pat. No. 4,498,660; U.S. Pat. No. 4,145,031; U.S. Pat. No. 3,698,692; U.S. Pat. No. 3,770,246; U.S. Pat. No. 5,255,897; and U.S. Design Pat. No. 273,333.

While these devices fulfill their respective, particular objectives and requirements, the aforementioned patents do not disclose a fence extension assembly for extending a vertical height of a fence which includes a plurality of mounting posts securable to opposed sides of an existing fence, and a plurality of panels extending between the posts and resting upon a top surface of the fence so as to extend an effective vertical height of the fence.

In these respects, the fence extension assembly according to the present invention substantially departs from the conventional concepts and designs of the prior art, and in so doing provides an apparatus primarily developed for the purpose of extending a vertical height of a fence.

SUMMARY OF THE INVENTION

In view of the foregoing disadvantages inherent in the known types of fence structures now present in the prior art, the present invention provides a new fence extension assembly construction wherein the same can be utilized for extending a vertical height of a fence. As such, the general purpose of the present invention, which will be described subsequently in greater detail, is to provide a new fence extension assembly apparatus and method which has many of the advantages of the fence structures mentioned heretofore and many novel features that result in a fence extension assembly which is not anticipated, rendered obvious, suggested, or even implied by any of the prior art fence structures, either alone or in any combination thereof.

To attain this, the present invention generally comprises an assembly for extending a vertical height of a fence. The inventive device includes a plurality of mounting posts securable to opposed sides of an existing fence. A plurality of panels extend between the posts and rest upon a top surface of the fence so as to extend an effective vertical height of the fence.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carded out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fence extension assembly apparatus and method which has many of the advantages of the fence structures mentioned heretofore and many novel features that result in a fence extension assembly which is not anticipated, rendered obvious, suggested, or even implied by any of the prior an tool guides, either alone or in any combination thereof.

It is another object of the present invention to provide a new fence extension assembly which may be easily and efficiently manufactured and marketed.

It is a further object of the present invention to provide a new fence extension assembly which is of a durable and reliable construction.

An even further object of the present invention is to provide a new fence extension assembly which is susceptible of a low cost of manufacture with regard to both materials and labor, and which accordingly is then susceptible of low prices of sale to the consuming public.

Still yet another object of the present invention is to provide a new fence extension assembly which provides in the apparatuses and methods of the prior art some of the advantages thereof, while simultaneously overcoming some of the disadvantages normally associated therewith.

Still another object of the present invention is to provide a new fence extension assembly for extending a vertical height of a fence.

Yet another object of the present invention is to provide a new fence extension assembly which includes a plurality of mounting posts securable to opposed sides of an existing fence, and a plurality of panels extending between the posts and resting upon a top surface of the fence so as to extend an effective vertical height of the fence.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
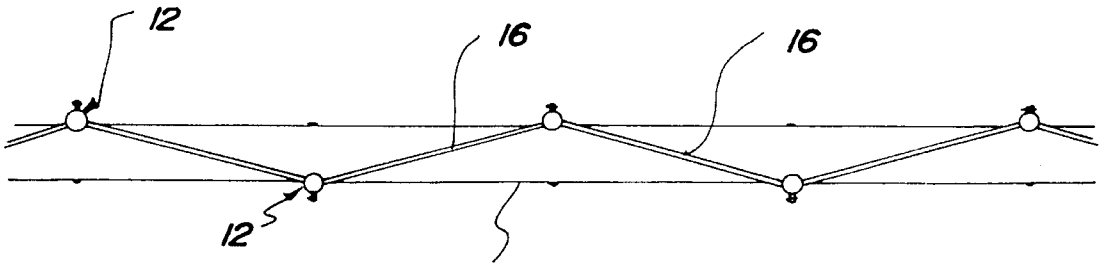
FIG. 2 is a top plan view of the invention illustrated in FIG. 1.

With reference now to the drawings, and in particular to FIGS. 1–11 thereof, a new fence extension assembly embodying the principles and concepts of the present invention and generally designated by the reference numeral 10 will be described.

More specifically, it will be noted that the fence extension assembly 10 comprises a plurality of mounting post means 12 for securing to opposed sides of an existing fence 14 so as to project vertically above an upper edge of the fence. A plurality of panels 16 is provided with the present invention 10, with each of the panels extending between a pair of the plurality of mounting post means 12 so as to extend diagonally across an upper edge of the existing fence 14. By this structure, a vertical height of the existing fence 14 is effectively raised, with an additional benefit of the invention 10 being the preventing of a passage of animals or the like along an upper edge of the existing fence.

Figure 3:
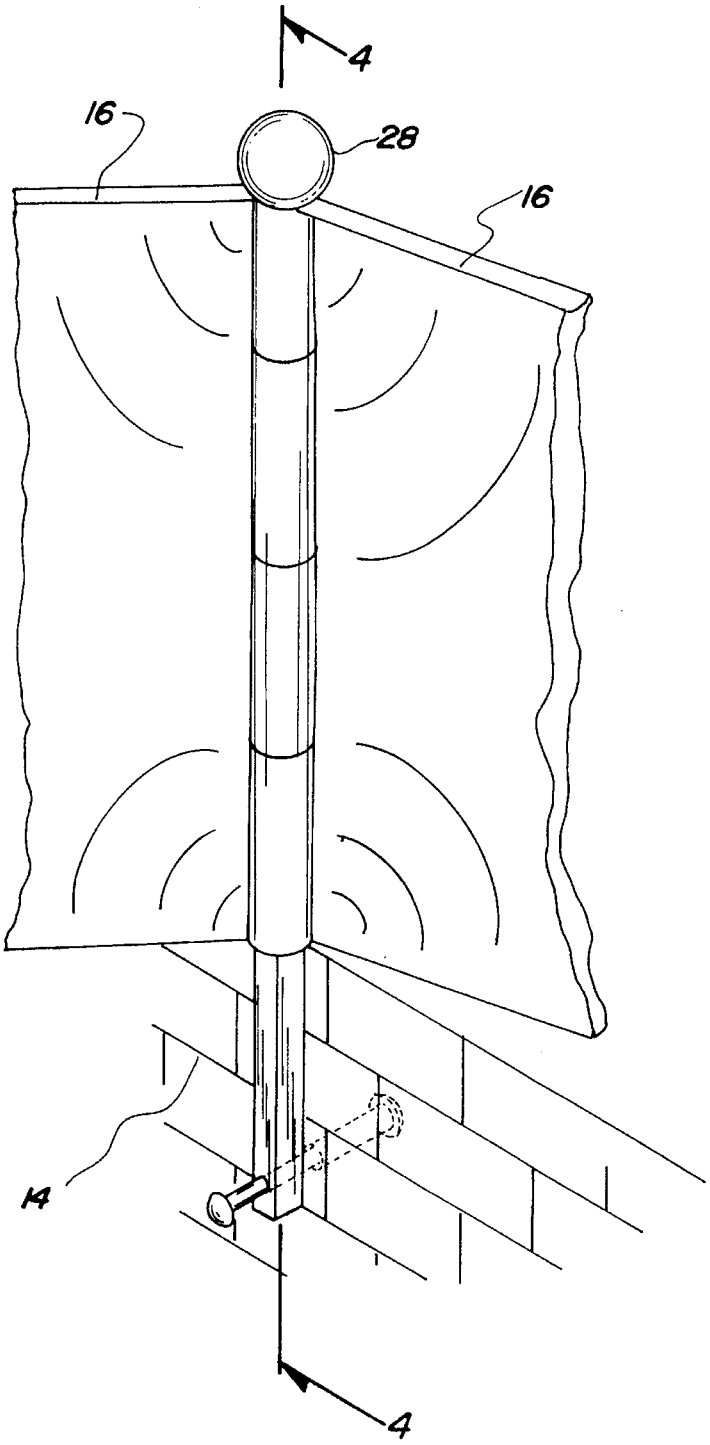
FIG. 3 is an enlarged isometric illustration of a portion of the present invention.
Figure 4:
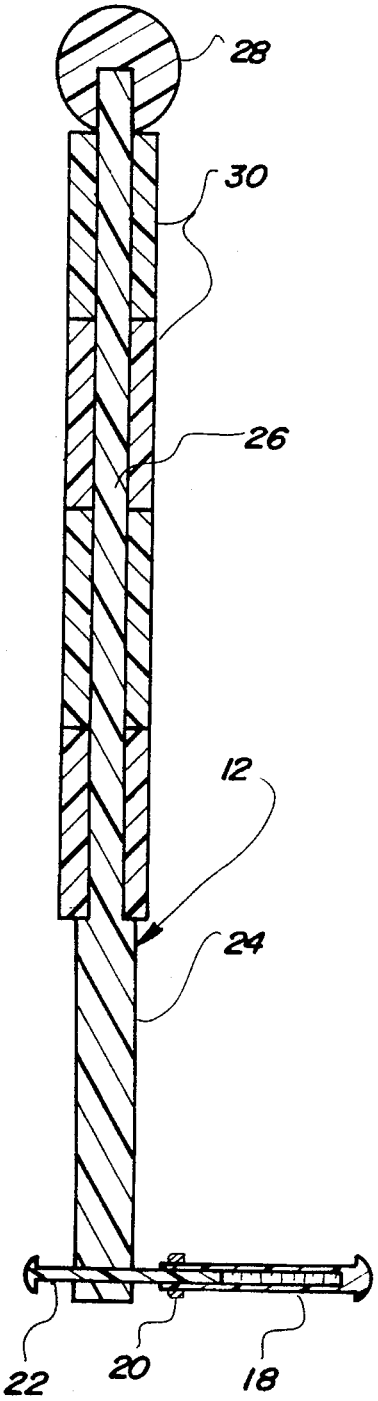
FIG. 4 is a cross-sectional view taken along line 4—4 of FIG. 3.
Figure 5:
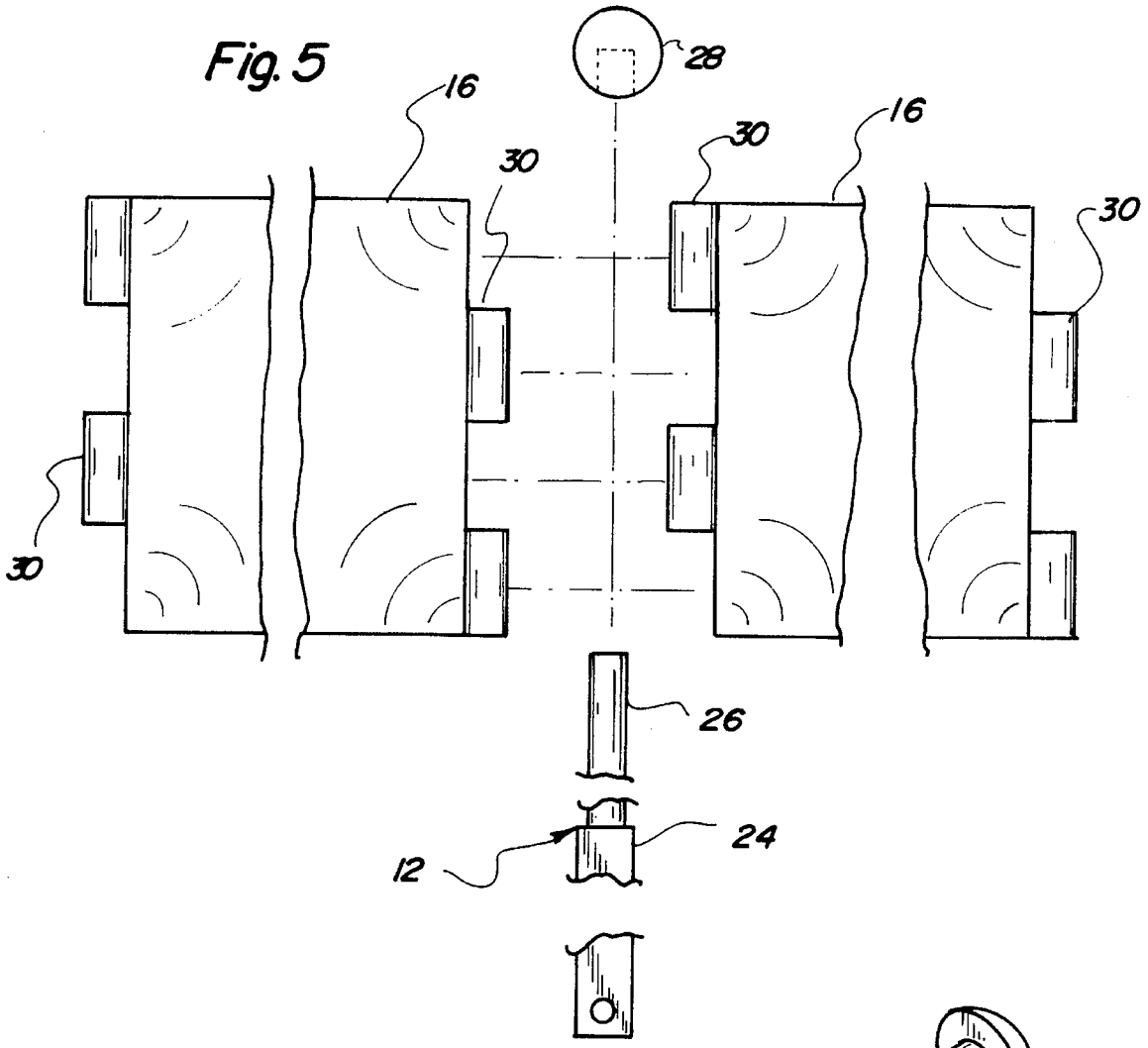
FIG. 5 is an exploded elevation view of a further portion of the present invention.
Figure 6:
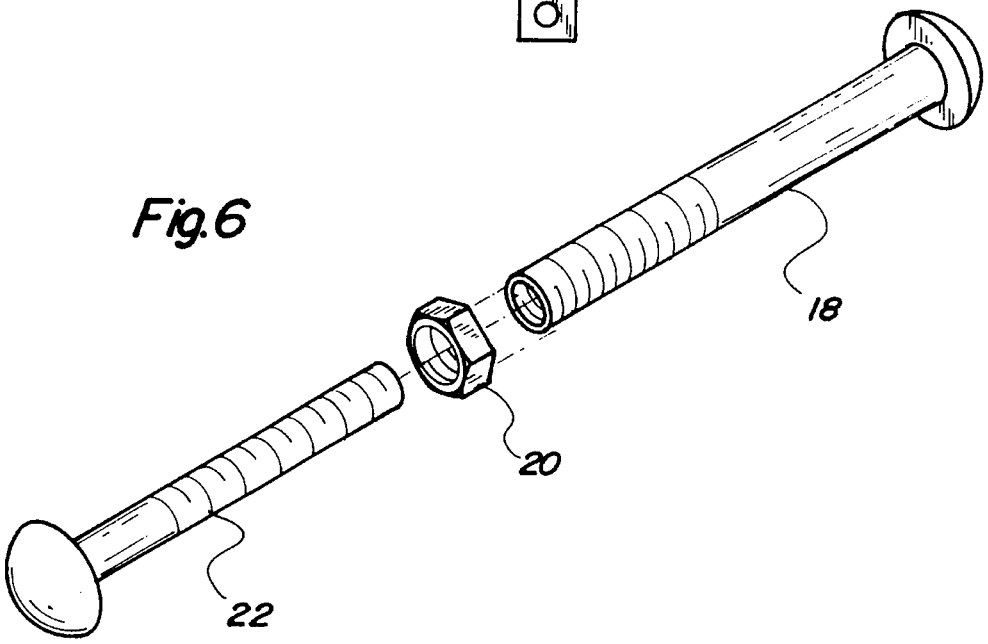
FIG. 6 is an exploded isometric illustration of a portion of a mounting means of the invention.
Figure 7:
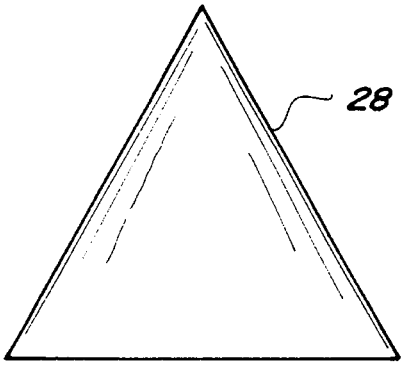
FIG. 7 is an elevation view of an alternative form of an end cap of the mounting means.

Referring now to FIGS. 1 through 6, it can be shown that the mounting means 12 of the present invention 10 preferably comprises a mounting receiver 18 securable to the existing fence 14 as shown in FIG. 3 of the drawings. To this end, the mounting receiver 18 can be positioned through an aperture directed through the existing fence 14, with a securing nut 20 threadably engaging an exterior of the mounting receiver 18 so as to couple the mounting receiver relative to the existing fence 14. A support rod 22, as shown in FIGS. 4 and 6, is threadably received within the mounting receiver 18 and can be axially adjusted relative thereto. A support stanchion 24 includes an unlabelled aperture through which a support rod 22 projects so as to movably couple the support stanchion 24 to the support rod 22. The support stanchion 24 extends from a support rod 22 and continues into a pivot pin 26 having a longitudinal axis colinearly oriented with a longitudinal axis of the support stanchion 24. The pivot pin 26 terminates in an upper distal end whereat an end cap 28 is removably coupled thereto. As shown in FIGS. 3 through 5, each of the panels 16 includes offset spaced hinge tubes 30 coupled to opposed lateral edges thereof through which the pivot pin 26 of the respective mounting means 12 extends so as to couple adjacent panels together in a pivotal fashion. By this structure, the panels 16 can be placed in the accordion-like or zig-zag configuration illustrated in FIGS. 1 and 2 of the drawings. Because the panels 16 are pivotally mounted relative to one another, and because the support stanchion 24 can be slidably positioned upon the support rod 22 at a desired distance from the existing fence 14, the device 10 can be easily configured to accommodate various distances between adjacent mounting means 12. In this respect, installation tolerances can be substantially relaxed so as to facilitate ease of installation of the device 10 to an existing fence 14. Further, such configuration of structure permits an individual to alter an angular orientation between adjacent panels 16 to achieve a desired visual appearance of the installed device 10.

Figure 8:
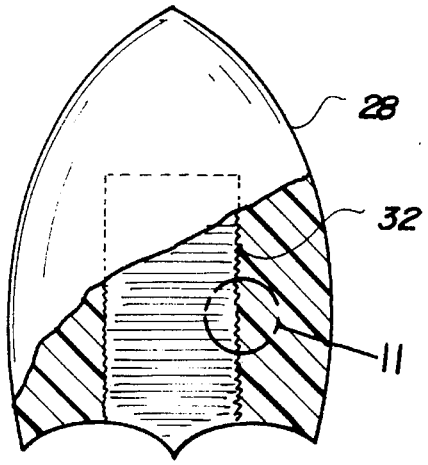
FIG. 8 is an elevation view, partially in cross-section, of a further alternative form of the end cap.
Figure 9:
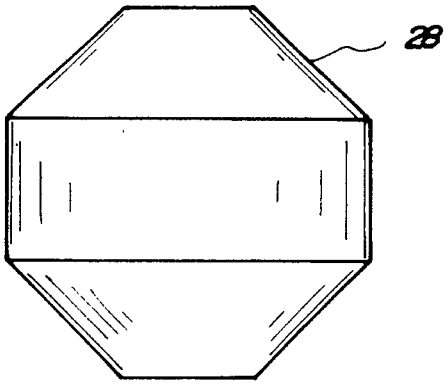
FIG. 9 is an elevation view of another further alternative form of the end cap.
Figure 10:
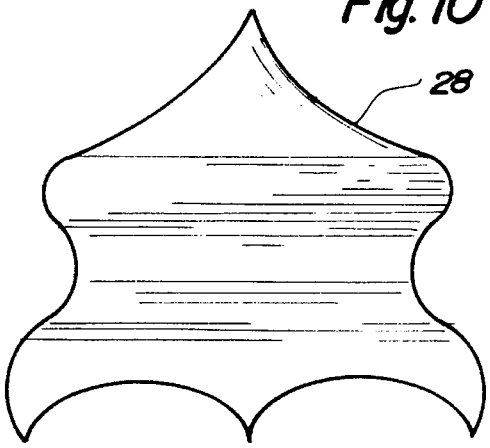
FIG. 10 is an elevation view of yet another further alternative form of the end cap.
Figure 11:
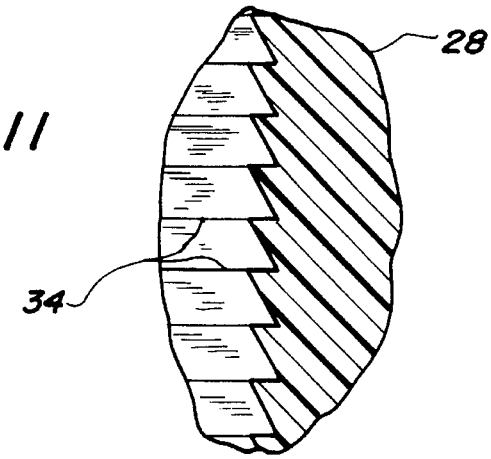
FIG. 11 is an enlarged cross-sectional view of the area set forth in FIG. 8.

The end cap 28 as shown in FIG. 3 of the drawings operates to secure the panels 16 relative to the mounting means 12. The end cap 28 can be spherical as shown in FIGS. 1 through 5, or alternatively can be of various ornamental shapes as illustrated in FIGS. 7 through 10. As shown in FIG. 8, each of the end caps includes a bore 32 directed thereinto which receives the upper end of the pivot pin 26. To enhance frictional engagement between the interior surface of the bore 32 and an exterior surface of the pivot pin, the bore 32 of the end cap 28 is desirably shaped so as to define a plurality of angled annular steps 34 extending concentrically thereabout which facilitate ease of positioning of the pivot pin 26 into the bore 32 of the end cap 28 and operates to resist subsequent separation thereof, as shown in FIG. 11 of the drawings.

Figure 1:
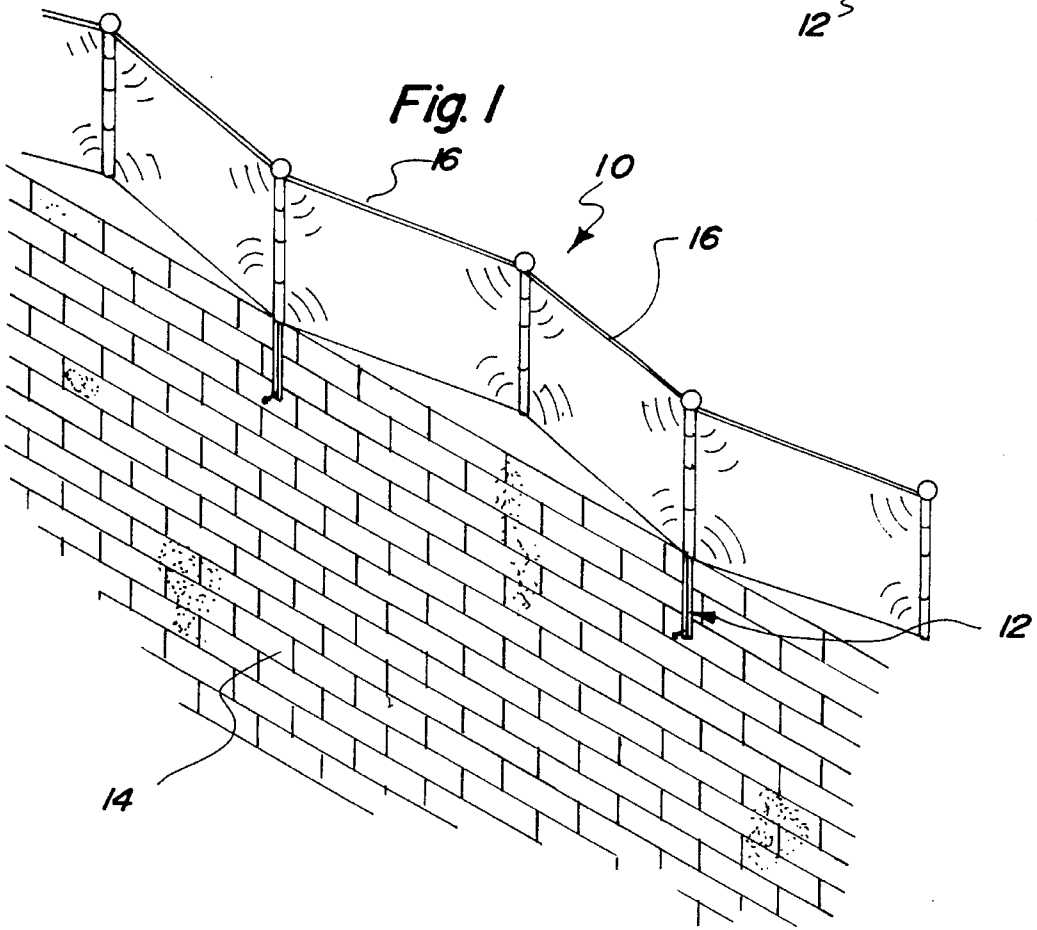
FIG. 1 is an isometric illustration of a fence extension assembly according to the present invention in use.

In use, the fence extension assembly 10 according to the present invention can be easily utilized to effectively extend a vertical height of a fence. The present invention 10, when installed as illustrated in FIGS. 1 and 2, extends in an accordion-like or zig-zag fashion across the top end of the fence 14 so as to preclude animals or other beings from travelling across an upper edge of the existing fence.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A fence extension assembly comprising:

a plurality of mounting post means for securing to opposed sides of an existing fence so as to project vertically above an upper edge of the fence, the amounting post means comprises a mounting receiver securable to an existing fence, the mounting receiver being positionable through an aperture directed through the existing fence, with a securing nut threadably engaging an exterior of the mounting receiver so as to permit coupling of the mounting receiver relative to the existing fence; a support rod threadably received within the mounting receiver; a support stanchion including an aperture through which the support rod projects so as to movably couple the support stanchion to the support rod, the support stanchion extending from the support rod and continuing into a pivot pin having a longitudinal axis colinearly oriented with a longitudinal axis of the support stanchion, the pivot pin terminating in an upper distal end; and an end cap removably coupled to the upper distal end;

a plurality of panels, each of the panels extending between an adjacent pair of the plurality of mounting post means so as to be extendable diagonally across an upper edge of the existing fence.

2. The fence extension assembly of claim 1, wherein each of the panels includes offset spaced hinge tubes coupled to opposed lateral edges thereof through which the pivot pin of a respective mounting post means extends so as to pivotally couple adjacent panels together.

3. The fence extension assembly of claim 2, wherein the end cap includes a bore directed thereinto which receives the upper end of the pivot pin.

4. The fence extension assembly of claim 3, wherein the bore of the end cap is shaped so as to define a plurality of angled annular steps extending concentrically thereabout which enhance frictional engagement between an interior surface of the bore and an exterior surface of the pivot pin.

5. A fence extension assembly comprising:

a fence having an upper edge;

a plurality of mounting post means secured to opposed sides of the fence for projecting vertically above the upper edge of the fence, the mounting post means comprises a mounting receiver extending through an aperture directed through the fence, a securing nut threadably engaging an exterior of the mounting receiver so as to secure the mounting receiver to the fence; a support rod threadably received within the mounting receiver; a support stanchion including an aperture through which the support rod projects so as to movably couple the support stanchion to the support rod, the support stanchion extending from the support rod and continuing into a pivot pin having a longitudinal axis colinearly oriented with a longitudinal axis of the support stanchion, the pivot pin terminating in an upper distal end; and an end cap removably coupled to the upper distal end;

a plurality of panels, each of the panels extending between an adjacent pair of the plurality of mounting post means and extending diagonally across the upper edge of the fence.

6. The fence extension assembly of claim 5, wherein each of the panels includes offset spaced hinge tubes coupled to opposed lateral edges thereof through which the pivot pin of a respective mounting post means extends so as to pivotally couple adjacent panels together.

7. The fence extension assembly of claim 6, wherein the end cap includes a bore directed thereinto which receives the upper end of the pivot pin.

8. The fence extension assembly of claim 7, wherein the bore of the end cap is shaped so as to define a plurality of angled annular steps extending concentrically thereabout which enhance frictional engagement between an interior surface of the bore and an exterior surface of the pivot pin.

* * * * *